United States Patent [19]

Ratcliffe et al.

[11] 4,107,368

[45] Aug. 15, 1978

[54] WATER REPELLANT FABRICS

[75] Inventors: Walter James Ratcliffe, Montreal; Robert W. Kolb, Beaconsfield; S. Esson Bruce, Mount Royal, all of Canada

[73] Assignee: Dominion Textile Limited, Montreal, Canada

[21] Appl. No.: 725,875

[22] Filed: Sep. 23, 1976

[30] Foreign Application Priority Data

Oct. 7, 1975 [GB] United Kingdom ..... 40982/75

[51] Int. Cl.[2] ..... B32B 7/00

[52] U.S. Cl. ..... 428/245; 139/425 R; 427/390 E; 428/253; 428/258; 428/263; 428/280; 428/288; 428/384

[58] Field of Search ..... 428/245, 253, 254, 263, 428/265, 267, 272, 280, 288, 321, 381, 389, 539, 258, 379; 8/115.6; 28/75 R; 139/420 R, 425 R; 427/390 E

[56] References Cited

U.S. PATENT DOCUMENTS

| | | | |
|---|---|---|---|
| 3,649,344 | 3/1972 | Crabtree et al. | 428/253 |
| 3,899,810 | 8/1975 | Stanley et al. | 139/426 R |

FOREIGN PATENT DOCUMENTS

| | | | |
|---|---|---|---|
| 1,277,914 | 1961 | France | 428/263 |

OTHER PUBLICATIONS

"Textile Chemicals & Auxiliaries", Henry Speel, p. 455, paragraphs 1-3, 1957.

*Primary Examiner*—James J. Bell
*Attorney, Agent, or Firm*—Larson, Taylor and Hinds

[57] ABSTRACT

Water repellant fabrics and methods of making them from yarns which have been given a water repellant treatment prior to incorporation into the fabric. A typical fabric is woven from a repellant treated polyester and polypropylene.

24 Claims, No Drawings

WATER REPELLANT FABRICS

BACKGROUND OF THE INVENTION

This invention relates to water-repellant yarns, to a process for making such yarns, and to fabrics produced from them.

It is well known that for a variety of purposes, water repellant fabrics are highly desirable. Typical applications are tarpaulins, tents, and various items of clothing. The level of water repellency, often erroneously also called water proofing (true water proofing can only be obtained with a continuous, water impermeable membrane) desired depends upon the end-use contemplated, and can vary from "shower proofing" (so-called) upwards. The known water repellent fabrics are generally prepared by treating the fabric — which may be woven, knitted, or non-woven such as felt — either before or after it has been made into the marketed product, with a water repelling agent, whereby a coating is left on the fabric. Usually this process is applied to the fabric as the last stage in its manufacture, prior to its being made up into a saleable article.

These known processes whereby water repellent coatings are applied to a fabric generally involve three steps, which are applied to a continuous single layer of fabric as it passes through a suitable treatment machine; for example by unrolling it from a bolt of cloth: first, a solution or dispersion of the agent is applied to the fabric; second, excess solvent is removed; and third, the fabric is briefly heated in order to cure the water repellent onto the fabric.

This procedure suffers from at least two major disadvantages. First, the treatment plant has to be wide enough to handle in flat form the fabric being processed. Since modern looms can produce fabrics up to at least 15 feet wide, this makes the treatment plant extremely expensive. Second, it is now common practice to produce fabrics from a mixture of yarns: but if a fabric is to be rendered water repellent, only yarns that will not be adversely affected by the treatment process may be used.

We have also found that nearly all the available processes for rendering a fabric water repellent cannot be applied to a yarn by means of conventional dye-house equipment, particularly a yarn including a synthetic fibre, in bulk or package form. By 'bulk or package form' is meant an amount of yarn as a thick skein, or wound onto a bobbin or the like. All of the known systems involve applying heat to the treated material in order to cure the repellent onto the fibre. We have found that with these known processes intended for fabrics, in order to obtain the required temperature at the center of a mass of yarn on a bobbin it is necessary to use such a high temperature that the yarn on the outside of the bobbin is adversely affected.

SUMMARY OF THE INVENTION

We have now found that by the use of a particular class of water repellent agents, water repellency can be obtained in a yarn in bulk form, adequately evenly throughout the bulk of yarn. Further, we have now discovered that a water repellent fabric can be obtained of adequate properties when not all of the fibres used in its preparation have been, or even can be, treated to render them water repellent.

The method of rendering a yarn in bulk form chosen from at least one of animal fibres, polyamide, cellulose acetates, cellulose triacetates, silk, polyester, nylon, acrylic, or wool, water repellent comprises the following steps:

(a) laundering the bulk yarn to remove surfactants, other surface coatings, and debris remaining from other yarn treatment processes such as dyeing;
(b) contacting the yarn with a warm alcoholic aqueous solution of a chromium or aluminium complex of a long-chain fatty acid;
(c) removing the aqueous alcoholic solvent; and
(d) drying the bulk yarn.

This process, and the yarn made thereby, is the subject of a copending application.

Preferably the bulk yarn is in package form, typically as a skein or wound onto a bobbin.

Preferably the fatty acid in the chromium or aluminium complex has a chain length of 13 to 17 carbon atoms, and is conveniently used as a 3% by weight solution in 3% methanol in water by weight, and preferably is used at a temperature of 35° to 50° C.

Conveniently the excess solvent is removed from the yarn packages by air extraction or centrifugation.

Preferably the yarn packages are dried by circulating warm air through them, preferably at a temperature of from 60° to 125° C.

DETAILED DESCRIPTION OF THE INVENTION

Many fibres are suitable for treatment by this process. The only ones that are not are, first, those which do not have any active sites whereat the fatty acid complex can become attached, for example polyethylene, second, those that are adversely affected by the acidic conditions existing during the processing steps, such as cotton and viscose-type fibres, and third, fibres that are inherently highly hydrophilic are extremely difficult to treat by this process in order to achieve a desirable level of water repellency.

So far as is known, these water repelling agents are compatible with the dyes commonly used on the specified fibres. However, it must be borne in mind, especially when pale shades are contemplated, that the chromium complexes are themselves coloured, and that therefore they will alter, to some extent, the colour of the fibre to which they are being applied. The aluminium complexes are essentially colourless and hence can be used for pale shades.

In a first aspect this invention comprises a method of making a water repellent fabric, which comprises knitting one or more strands, at least one of which has been rendered water repellent by applying thereto prior to knitting a chromium or aluminium complex of a long chain fatty acid, the treated strand being chosen from at least one of animal fibres, polyamide, cellulose acetates, cellulose triacetates, silk, polyester, nylon, acrylic or wool.

In a second aspect this invention comprises a method of making a water repellent fabric which comprises weaving two or more strands, at least one of which has been rendered water repellent by applying thereto prior to weaving a chromium or aluminium complex of a long chain fatty acid, the treated strand being chosen from at least one of animal fibres, polyamide, cellulose acetates, cellulose triacetates, silk, polyester, nylon, acrylic or wool.

Preferably two strands are used; conveniently one strand can provide the warp and the other the weft, as two separate strands. Alternatively each strand can be a multiple ply strand comprising both treated and untreated yarns. Alternatively the second or subsequent strand may be one which is naturally water repellent or one which cannot be rendered water repellent in bulk form. A particularly preferred combination is one in which the repellent strand is nylon, wool, acrylic or polyester, and the untreated strand is a polyolefin-type material. Of considerable interest is a fabric comprising polypropylene strands in one direction and water repellent treated polyester strands in the other.

In a third aspect this invention comprises a method of producing a non-woven water repellent fabric which comprises producing a batt or the like from a mixture of fibres, at least one of which has been rendered water repellent by applying thereto prior to mixing a chromium or aluminium complex of a long chain fatty acid, the treated fibre being chosen from at least one of animal fibres, polyamide, cellulose acetates, cellulose triacetates, silk, polyester, nylon, acrylic or wool.

In a fourth aspect this invention comprises a water repellent knitted fabric knitted from one or more strands, at least one of which has been rendered water repellent by applying thereto prior to knitting a chromium or aluminium complex of a long chain fatty acid, the treated strand being chosen from at least one of animal fibres, polyamide, cellulose acetates, cellulose triacetates, silk, polyester, nylon, acrylic or wool.

In a fifth aspect this invention comprises a water repellent woven fabric, woven from two or more strands at least one of which has been rendered water repellent by applying thereto prior to weaving a chromium or aluminium complex of a long chain fatty acid, the treated strand being chosen from at least one of animal fibres, polyamide, cellulose acetates, cellulose triacetates, silk, polyester, nylon, acrylic or wool.

In a sixth aspect this invention comprises a water repellent non-woven fabric containing a mixture of fibres, at least one of which has been rendered water repellent by applying thereto prior to mixing a chromium or aluminium complex of a long chain fatty acid, the treated fibre being chosen from at least one of animal fibres, polyamide, cellulose acetates, cellulose triacetates, silk, polyester, nylon, acrylic or wool.

Thus in its broadest method aspect this invention provides a method of making a water repellent fabric which comprises combining into the fabric structure one or more fibres or strands, at least one of which fibres or strands is chosen from at least one of animal fibres, polyamide, cellulose acetates, cellulose triacetates, silk, polyester, nylon, acrylic, or wool, the chosen fibre or strand having been rendered water repellent by applying thereto prior to the combination of said fibre or strand into the fabric structure a chromium or aluminium complex of a long chain fatty acid.

Preferably in all of these aspects of this invention, the long chain fatty acid in the chromium or aluminium complex has a chain length of 13 to 17 carbon atoms.

In an alternative broad aspect, this invention comprises a water repellent fabric containing in the fabric structure one or more fibres or strands, at least one of which fibres or strands has been rendered water repellent by applying thereto prior to the combination of said fibre or strand into the structure of the fabric a chromium or aluminium complex of a long chain fatty acid, the treated fibre or strand being chosen from at least one of animal fibres, polyamide, cellulose acetate, cellulose triacetate, silk, polyester, nylon, acrylic, or wool.

This invention, in its broadest forms, relies on a pair of related discoveries. First, it is possible to render certain yarns in bulk form water repellent, by the specific use of the chromium or aluminium complexes of long chain fatty acids, without adversely affecting the yarn, without need for specialized yarn treating equipment. Second, a fabric can be produced in which a treated yarn is combined with a yarn that has not been treated, which retains adequate water repellency. When a treated yarn is combined with an untreated yarn, several possible combinations exist.

First, the treated and untreated yarns can be the same, for example as the warp and weft in a woven fabric. Second, the treated and untreated yarns can be different, and especially the second yarn can be one to which this water repellency process need not, or cannot, be applied.

This feature of this invention is best demonstrated by considering two exemplary situations.

A. Some yarns, whether in bulk or after forming into a fabric, either cannot be treated by the known water repellency procedures due frequently to the temperatures involved, or are so chemically inert as to be unaffected by them, for example polyethylene and polypropylene. But by combining in a 1/1 weave a polypropylene strand and a treated polyester strand, a water repellent fabric is obtained.

B. In some fabrics diverse requirements have to be met: for example the inner, fluffy, side of a track suit or sweat suit needs to be water absorbent, whilst the outer knit "shell" ideally is at least shower proof. Such a fabric can easily be obtained by combining in the knit cotton, for the inner side, and a treated acrylic for the outer "shell".

For some applications it is also possible that a multiple ply strand could be used to form a fabric, of which only a portion has been rendered water repellent; an example is a polyester core which is untreated, with an outer layer of treated material.

In considering such combinations, the point to be borne in mind is that the presence of an untreated yarn, as a fibre or as a strand, will often decrease the water repellency capability of the final fabric. It is a matter of simple experiment to determine just how much treated yarn needs to be used, in order to obtain the desired water repellency in the final fabric, taking into account the structure of that fabric.

It is also to be noted that the yarns of this invention can be used in any of the standard ways of making fabrics, not only weaving and knitting, but also in non-woven fabrics such as felts.

The yarn treating process can be carried out in any standard apparatus suitable for the treatment of bulk yarn with solutions, for example dyeing apparatus. The requirements it must meet are effectively the same as those for dyeing: it must be possible to adequately contact the entire mass of yarn in the package with the solution, to remove the solution, and to dry the package thereafter. The apparatus must be so sized as to handle adequately the size of package of bulk yarn to be treated, for example wound bobbins or skeins. We prefer to use yarn packages comprising a bulk of yarn on a bobbin as this appears to be easier to handle.

In detail, the process comprises the following steps:

(a) The packaged yarn is cleaned, as far as possible. The nature of the cleaning process will depend on the earlier history and type of yarn being processed. Surfactants should be removed as far as possible, however, as any remaining behind will adversely affect the water repellency obtained. Also dirt, and debris remaining from, for example, a dyeing step should be removed. The yarn need not be dried after cleaning it.

(b) The packaged yarn is contacted with an alcoholic solution of the fatty acid complex in water. Generally a 3% solution (by weight) in 3% methanol (by weight) in water is used, but other concentrations and alcohols, for example isopropanol, can be used. The time of contacting depends on a combination of yarn package size, and the flow through the package. For conventional packages in stock dyeing equipment, we have found a time of 15 to 20 minutes generally to be adequate, but other times can be used. Generally the contacting is carried out at a temperature of 35° to 50° C.

(c) The solution is removed from the yarn packages as far as possible, by centrifugation or air extraction, for example, or by any other suitable means. Without exposing the packages to damage, as much of the solution as possible should be removed, as this will lessen the thermal burden required in the following drying and curing step.

(d) The yarn package is dried, preferably by circulating warm air through it, at a temperature of 60° to 125° C. until it is dry. Thus the time required is a complex function of air temperature, air circulation rate, package size, and package water content. It is however essential that the centre of the package be adequately dried, since this step serves both to remove the remaining water, and to cure the water repellency agent onto the yarn being processed.

In the following tables are presented data concerning the water repellency performance of various fabrics made according to this invention. Some other fabrics are also included for comparison purposes. The test is the Water Spray Test, as defined in the Canadian Government Standards Bureau Test 4 GP 2 (which is equivalent to the American Association of Textile Chemists and Colorists Test 22-1971), which assesses the extent of wetting resulting from spraying a measured amount of water against a fabric specimen under specified test conditions.

TABLE

| Fabric Type | | | Spray Test Rating |
|---|---|---|---|
| Loose, single knit fabric, suitable for cardigans, 100% acrylic fibre, untreated | | | 0 |
| Loose, single knit fabric, suitable for cardigans, 100% acrylic fibre, treated | | | 90–100 |
| Plain weave fabric, 500 denier polypropylene tape warp, 100% polyester weft, untreated. | | | |
| Oz/sq. yd. | warp ends/inch | weft picks/inch | |
| 7.7 | 24 | 34 | 0 |
| 6.3 | 24 | 46 | 0 |
| Plain weave fabric, 500 denier polyprpylene tape warp, 100% polyester weft, treated. | | | |
| Oz/sq. yd. | warp ends/inch | weft picks/inch | |
| 7.7 | 24 | 34 | 80–90 |
| 6.3 | 24 | 46 | 90 |

What we claim as our invention is:

1. A method of making a water repellent fabric consisting of combining into the fabric structure at least one strand chosen from at least one of animal fibres, polyamide, cellulose acetate, cellulose triacetate, silk, polyester, acrylic and wool, the chosen strand having been rendered water repellent by applying thereto prior to the combination of said strand into said fabric structure at least one complex chosen from the long chain fatty acid complexes of chromium and aluminum.

2. Method according to claim 1 consisting of knitting at least one strand which has been rendered water repellent by applying thereto prior to knitting at least one complex chosen from the long chain fatty acid complexes of aluminum and chromium, the treated strand being chosen from at least one of animal fibres, polyamide, cellulose acetate, cellulose triacetate, silk, polyester, acrylic, and wool.

3. Method according to claim 2 wherein the treated strand is acrylic.

4. Method according to claim 1 consisting of weaving at least two strands, at least one of which has been rendered water repellent by applying thereto prior to weaving at least one complex chosen from the long chain fatty acid complexes of chromium and aluminium, the treated strand being chosen from at least one of animal fibres, polyamide, cellulose acetate, cellulose triacetate, silk, polyester, acrylic and wool.

5. Method according to claim 1 consisting of producing a non-woven water repellent fabric by producing a batt from a mixture of fibres, at least one of which has been rendered water repellent by applying thereto prior to mixing at least one complex chosen from the long chain fatty acid complexes of chromium and aluminum, the treated fibre being chosen from at least one of animal fibres, polyamide, cellulose acetate, cellulose triacetate, silk, polyester, acrylic and wool.

6. Method according to claim 4 wherein two strands are used, one as weft and the other as warp, of which strands only one is water repellent treated.

7. Method according to claim 4 wherein two different strands are used, one as weft and the other as warp, one of which strands is water repellent treated, and the other of which is not susceptible to being water repellent treated.

8. Method according to claim 7 wherein the water repellent treated strand is chosen from nylon, wool, acrylic, and polyester, and the second strand is a polyolefin type material.

9. Method according to claim 8 wherein polypropylene strands are used as the warp, and water repellent treated polyester strands as the weft.

10. Method according to claim 2 wherein the long chain fatty acid in the complex has a chain length of 13 to 17 carbon atoms.

11. Method according to claim 3 wherein the long chain fatty acid in the complex has a chain length of 13 to 17 carbon atoms.

12. Method according to claim 4 wherein the long chain fatty acid in the complex has a chain length of 13 to 17 carbon atoms.

13. A water repellent fabric containing in the fabric structure at least one strand which has been rendered water repellent by applying thereto prior to the combination of said strand into the structure of the fabric at least one complex chosen from the long chain fatty acid complexes of chromium and aluminum, the treated strand being chosen from at least one of animal fibres, polyamide, cellulose acetate, cellulose triacetate, silk, polyester, acrylic, and wool.

14. Fabric according to claim 13, consisting of a water repellent knitted fabric from at least one strand which has been rendered water repellent by applying thereto prior to the combination of said strand into the structure of the fabric at least one complex chosen from the long chain fatty acid complexes of chromium and aluminum, the treated strand being chosen from at least one of animal fibres, polyamide, cellulose acetate, cellulose triacetate, silk, polyester, acrylic and wool.

15. Fabric according to claim 13, consisting of a water repellent woven fabric, woven from at least two strands, at least one of which strands has been rendered water repellent by applying thereto prior to the combination thereof into the structure of the fabric at least one complex chosen from the long chain fatty acid complexes of chromium and aluminium, the treated strand being chosen from at least one of animal fibres, polyamide, cellulose acetate, cellulose triacetate, silk, polyester, acrylic and wool.

16. Fabric according to claim 13 consisting of a water repellent non-woven fabric, containing a mixture of fibres, at least one of which fibres has been rendered water repellent by applying thereto prior to the combination of said fibre into the structure of the fabric at least one complex chosen from the long chain fatty acid complexes of chromium and aluminium, the treated fibre being chosen from at least one of animal fibres, polyamide, cellulose acetate, cellulose triacetate, silk, polyester, acrylic and wool.

17. Fabric according to claim 14 wherein the water repellent treated yarn is chosen from at least one of polyester and acrylic.

18. Fabric according to claim 15, wherein two strands are used, one as weft, the other as warp, only one of which has been water repellent treated.

19. Fabric according to claim 15 wherein two different strands are used, one as weft and the other as warp, one of which strands is water repellent treated, and the other of which is not susceptible to being water repellent treated.

20. Fabric according to claim 17 wherein the water repellent treated strand is chosen from at least one of nylon, wool, acrylic, and polyester, and the second strand is a polyolefin type material.

21. Fabric according to claim 17 wherein polyolefin strands are used as the warp, and water repellent treated polyester strands as the weft.

22. Fabric according to claim 14 wherein the long chain fatty acid in the complex has a chain length of 13 to 17 carbon atoms.

23. Fabric according to claim 15 wherein the long chain fatty acid in the complex has a chain length of 13 to 17 carbon atoms.

24. Fabric according to claim 16 wherein the long chain fatty acid in the complex has a chain length of 13 to 17 carbon atoms.

* * * * *